United States Patent [19]

Eyestone et al.

[11] 4,172,965

[45] Oct. 30, 1979

[54] PACKAGED INDUCTIVE COIL ASSEMBLY

[75] Inventors: John D. Eyestone, LaGrange Park; Michael E. Szymanski, Naperville, both of Ill.

[73] Assignee: Western Electric Company, Incorporated, New York, N.Y.

[21] Appl. No.: 864,304

[22] Filed: Dec. 27, 1977

[51] Int. Cl.[2] ..... H01F 27/02; H01F 15/02; H01F 17/08

[52] U.S. Cl. ..... 178/46; 336/90; 336/92; 336/96

[58] Field of Search ..... 336/65, 180, 67, 90, 336/92, 96, 107; 178/45, 46; 174/52 R, 52 PE, 52 S

[56] References Cited

U.S. PATENT DOCUMENTS

| | | | |
|---|---|---|---|
| 1,449,666 | 3/1923 | Gilchrist et al. | 336/65 X |
| 2,079,697 | 5/1937 | Ranges | 336/180 X |
| 3,691,294 | 9/1972 | Charles | 336/65 X |
| 3,943,412 | 3/1976 | Wickstrom | 336/67 X |
| 3,964,009 | 6/1976 | Bernstein et al. | 336/92 X |

*Primary Examiner*—Alfred E. Smith
*Assistant Examiner*—Marvin Nussbaum
*Attorney, Agent, or Firm*—R. P. Miller

[57] ABSTRACT

A plurality of individual toroidal loading or inductive coils mounted on a fiberglass dowel are positioned within a D-shaped case so that wiring spaces are provided between the peripheries of the coils and the junctures of the arcuate and straight sections of the case. Terminal strips are laid in the wiring spaces so that coil and stub cable wires may be secured to terminal posts projecting from the strips. The case is provided with openings to permit encapsulation of the coils. The D-shaped configuration of the case permits compact assembly of a number of cases within an outer casing.

11 Claims, 10 Drawing Figures

PACKAGED INDUCTIVE COIL ASSEMBLY

TECHNICAL FIELD OF THE INVENTION

This invention relates to packaged inductive coil assemblies and, more particularly, to D-shaped plastic cases for receiving stacks of individual inductive coils and associated terminal wiring, which cases may be compactly arrayed and encapsulated within an outer plastic casing.

BACKGROUND ART

Packaged arrays of inductive coils have extensive use in telephone communication systems wherein there is a need to add inductance to various types of communication circuits. Assemblies of toroidal coils find extensive usage as inductive coils in telephone cable transmission systems wherein the loading coils act to compensate for capacitance between the wire pairs extending to subscribers' stations. Other assemblies of toroidal wound coils find utility as inductor devices used to balance subscriber lines in telephone exchanges.

Loading coil assemblies may vary in size and contain as many as several hundred toroidal wound coils. In order to facilitate assembly, subsequent handling, and installation, it is essential that the assemblies be provided with mounting facilities and structural arrangements that insure ease of manufacture, compactness, and light weight while providing an overall construction that is rugged and that permits complete encapsulation to seal the assembly from the environment.

Numerous diverse arrangements have been devised to package loading coils in an attempt to facilitate assembly and wiring of compact assemblages of individual coils. An example of the prior art may be found in U.S. Pat. No. 2,147,245, which discloses stacks of toroidal coils mounted on dowels and positioned within slit circular metallic tubes so that a number of tubes may be assembled and encapsulated within a metal casing. Further examples of packaged loading coils are disclosed in U.S. Pat. No. 2,692,302, which shows a screened cylinder for receiving stacks of coils; U.S. Pat. No. 2,548,205, which discloses cardboard mounting tubes for receiving stacks of coils; U.S. Pat. No. 3,526,712, which illustrates circular arrays of coils mounted along and about a central post and British Patent No. 366,791, which discloses a number of carrier frames supporting individual coils or coil containers in such a fashion that the carrier frames may be mounted within a protective metallic case.

Recently, the Western Electric Company, Inc. has furnished packaged loading coil assemblies wherein a stack of toroidal coils are mounted on a rod and then a a pair of stacks are assembled into a contoured rectangular-shaped plastic case. These cases, which are generally oval in shape, are further assembled about a core, wrapped with a corrugated liner, tied, placed between plastic cover halves, and finally the assemblage is encapsulated. This loading coil assembly is further shown in a patent application filed in the name of Robert J. Reinebach even date herewith, Ser. No. 864,303.

U.S. Pat. No. 3,964,009 shows a case for housing a choke coil which comprises two hinged circular-shaped pockets, one of which has two enlargements to receive a pair of guide pins about which are laid the coil wires that run through necked extensions of the case to suitable connections.

SUMMARY OF THE INVENTION

The present invention contemplates, among other things, a unique modular loading coil shell or case that is constructed of insulating material which permits compact packaging of individual toroidal coils while allowing easy and efficient wiring and securing of coil wires and cable wires. The coil cases are shaped and formed to facilitate compact assembly within an outer casing whereafter the entire assembly may be readily encapsulated to preclude possible electrical breakdowns between stacks of coils.

More particularly, the individual toroidal coils are packaged within a D-shaped case that may be formed by wrapping or folding a perforated plastic sheet about a stack of coils. The sheet may have a flat section to form the arcuate-shaped portion of the package and a pair of angularly extending edge sections which are brought together to form the straight section of the D-shape package. The D-shaped case may also be formed by an extrusion process whereafter a stack of coils is positioned within the case. The case may be provided with holes or inwardly projecting spacer ribs or ridges to permit the free flow of encapsulating material about the individual coils.

The D-shape of the case permits the assemblage of the coils within the arcuate portion of the case so that wiring spaces are provided between the junctures of the straight and arcuate sections of the case. A terminal strip is laid within each wiring space and has a plurality of terminal posts projecting therefrom to receive stub cable wires and wires from the individual toroidal coils. The straight section of the D-shaped case is provided with an elongated opening that lends added flexibility to the case and provides an opening for the free flow of a subsequently applied encapsulant. The D-shaped configuration allows the compact assembly of numbers of D-shaped packages within an outer plastic casing.

BRIEF DESCRIPTION OF THE DRAWING

Other features and advantages of the present invention will be apparent upon consideration of the detailed specification and the drawing, wherein.

DETAILED DESCRIPTION

Figures 1, 2:
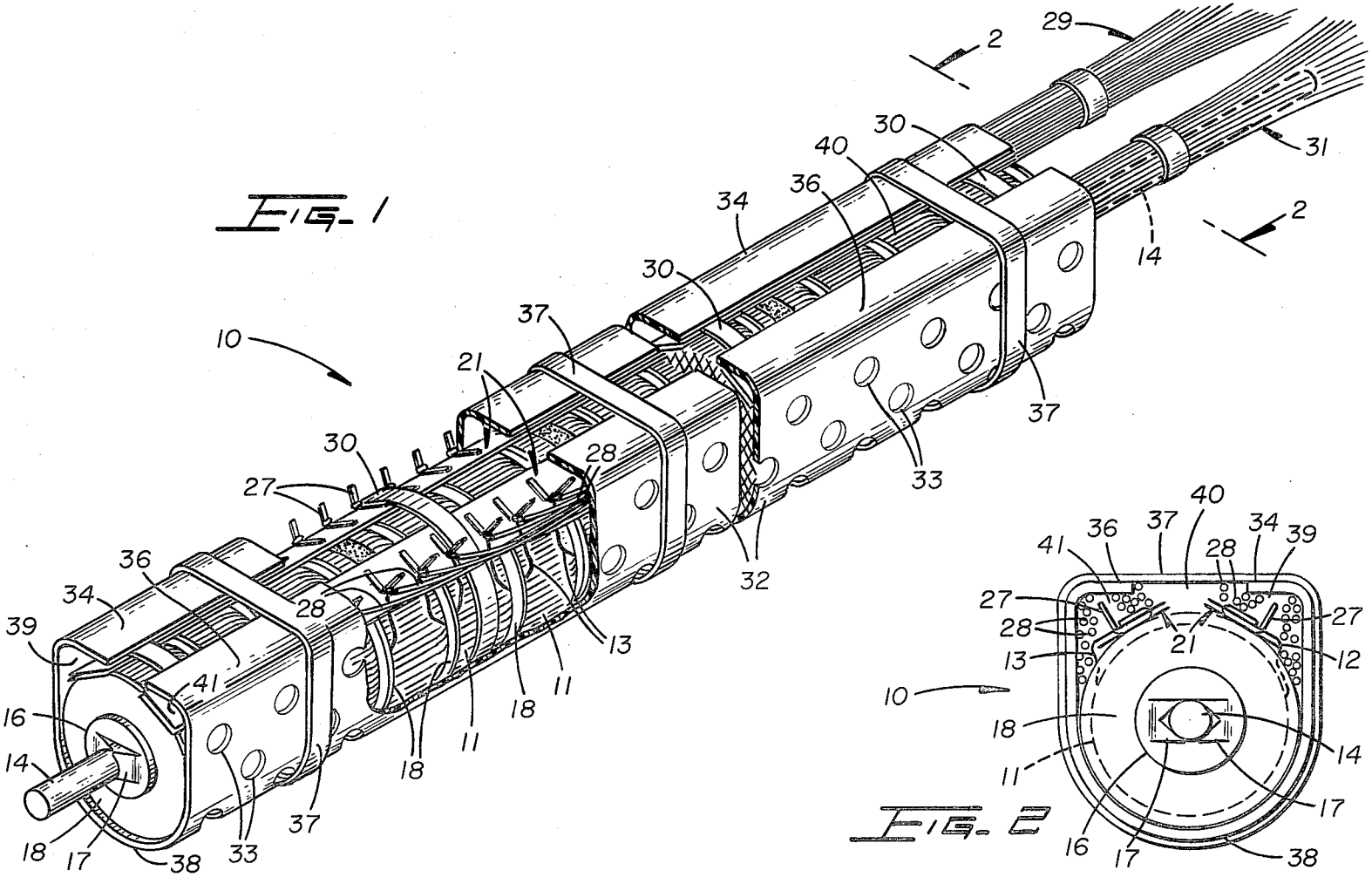
FIG. 1 is a perspective view, partially cut away, of an inductive coil assemblage packaged within a D-shaped case in accordance with the principles of the present invention.
FIG. 2 is an end view of the packaged coil shown in FIG. 1 particularly illustrating the wiring interconnections positioned in spaces provided at the junctures of the arcuate and straight sections of the D-shaped case.
Figure 3:
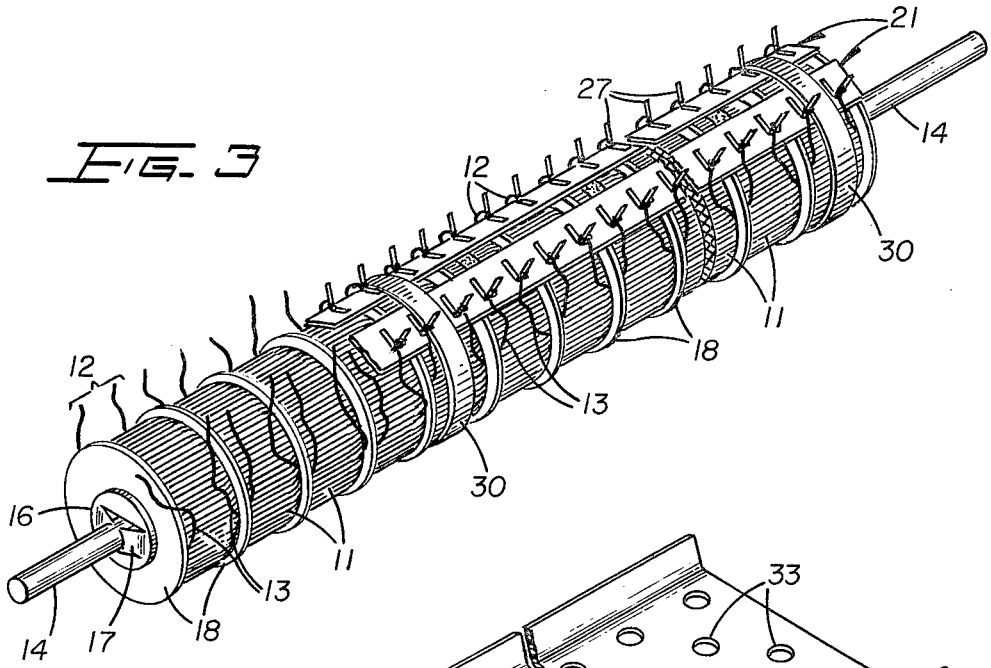
FIG. 3 is a perspective view of a stack of individual toroidal coils mounted on a central rod together with a showing of the wiring terminals.

Referring now to the drawing, wherein FIG. 1 illustrates a D-pack loading coil case assembly 10 embodying the principles of the present invention. Each coil comprises two windings about a toroidal core constructed of powdered Permalloy. The windings terminate in pairs of coil wires 12 and 13, see also FIG. 3. The toroidal coils are mounted on a central rod 14 or dowel constructed of fiberglass and are secured in place by lock washers or speed nuts 16 having tabs 17 which bite into the rod. Interposed between the toroidal coils are epoxy coated washers 18 that act as spacers and as means for preventing crosstalk between communication circuits including the individual coil windings. The washers may be constructed of epoxy coated steel when the coil assembly is used as a loading coil to compensate for capacitance between wire pairs in a telephone communication cable.

When the assembled coils are used as an inductive device to balance subscribers' lines terminating in a telephone exchange, the epoxy coated washers are constructed of powdered Permalloy, so that each coil is isolated from its adjacent coils to preclude any possibility of crosstalk between the individual coils.

Figure 5:
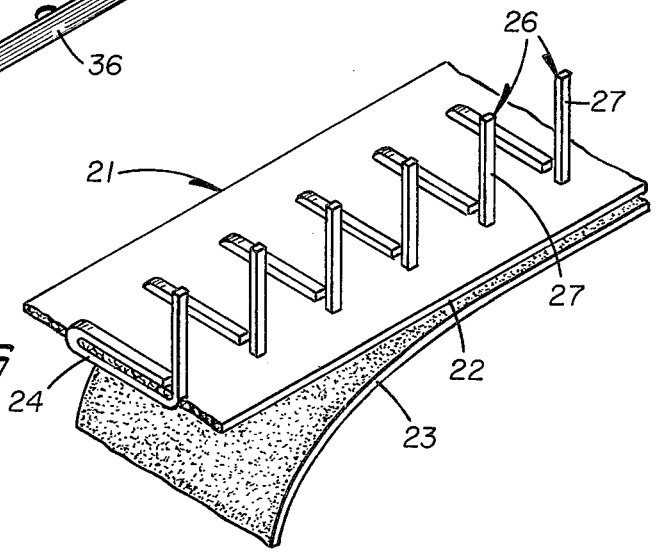
FIG. 5 is a perspective view of the wiring terminal supported on fiber strips.

Arcuately spaced on one section of the periphery of the stacked coils 11 are two fiber terminal strips 21, the construction of which is further shown in FIG. 5. The fiber strip actually consists of two strips 22 and 23 adhered together to captivate legs 24 of stitched terminals 26. Leg 24 is bent over to secure the terminals 26 to the strip 22. Each terminal includes an upwardly projecting terminal post 27 to which is secured a coil wire 12 or 13 and a cable wire 28 of a wire bundle 29 or 31. The coil wire and cable wire are respectively wrapped around a post 27 and then further secured with solder. Two strips 21 are laid parallel to each other on the assembled toroidal coils, and are secured thereto by bands 30 of tape wound around spaced toroidal coils. The tape is of an electrical grade polyester with a pressure-sensitive adhesive facing.

Figure 4:
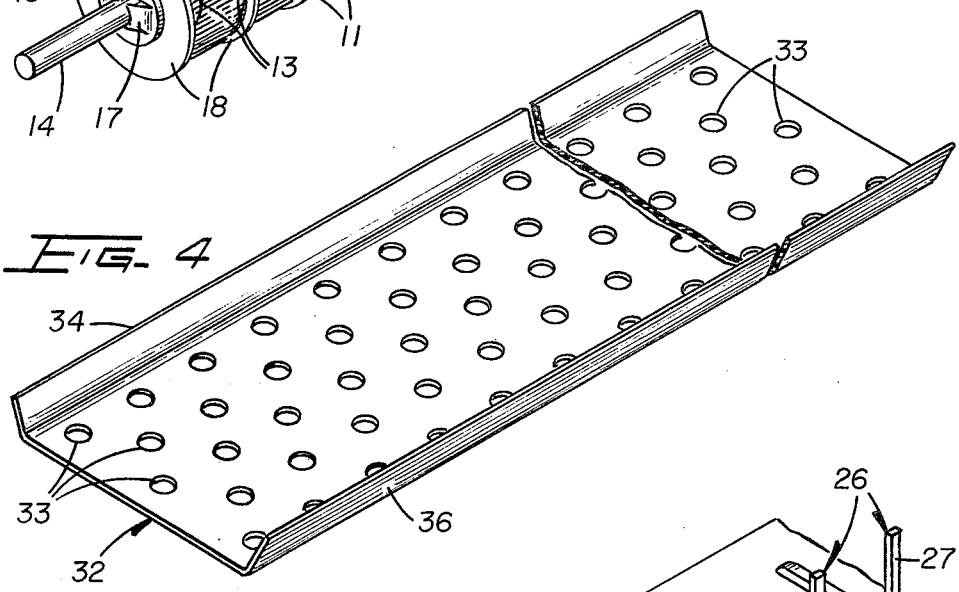
FIG. 4 is a perspective view of a perforated sheet of plastic material that is later folded about the stacked coils to form the D-shaped case.

Considering now the outer shell or case for the D-pack 10, attention is directed to FIGS. 1 and 4, wherein there is shown in FIG. 4, a sheet of thin cellulose acetate propionate 32 having an orderly array of holes 33 formed therein. The outer edges of the sheet 32 are bent angularly upwardly to provide straight fold sections 34 and 36. The sheet 32 is wrapped or formed about the terminal strip and coil assembly shown in FIG. 3 to form a D-shaped case or shell and the entire assembly may now be termed a D-pack. The formed sheet is held in position by electrical grade bands of pressure-sensitive tape 37. When the sheet 32 is formed about the coil assembly, the folds 34 and 36 are moved into the same plane to form a straight section of the D-shaped pack. A folded section 38 of the sheet 32 is substantially arcuate in shape to conform to the arcuate shape of the toroidal coils. It will be noted from FIG. 2 that the juncture of the straight section formed by the folds 34 and 36 with the arcuate section 38 formed by the remainder of the sheet provides openings 39 and 41, which may be termed "wiring spaces." These spaces are large enough to receive the terminal strips 21 with the projecting terminal posts 27, the coil wires, and the cable wires. The bundles of cable wires 29 and 31 may run to a stub cable which, in turn, may be attached to a quick connect connector to enable attachment into a telephone transmission line.

Figure 6:
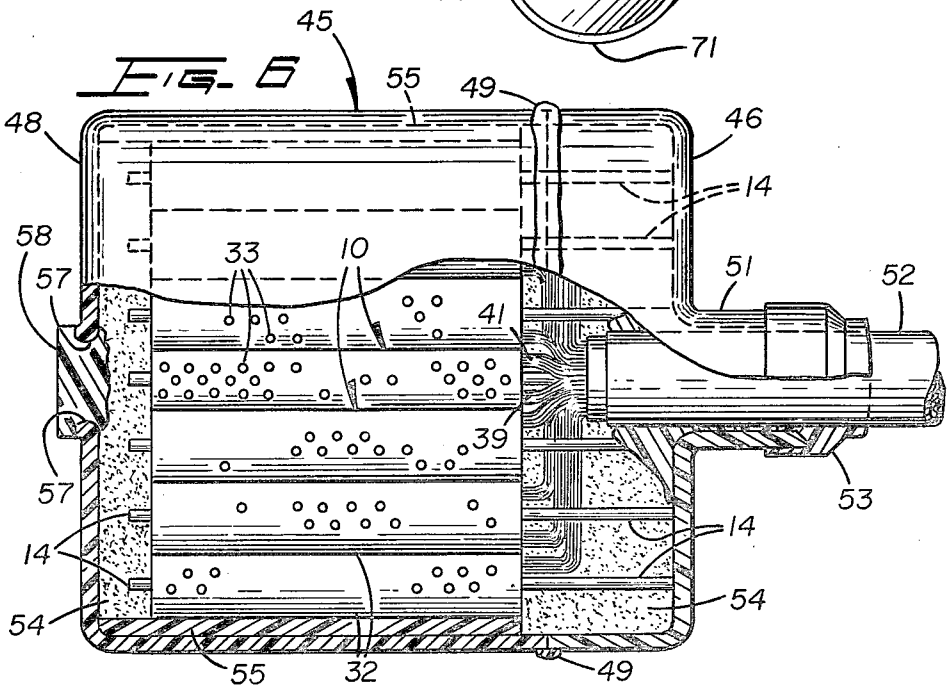
FIG. 6 is a side view of an inductive coil assembly partially cut away to disclose a number of individual D-shaped coil cases.
Figure 7:
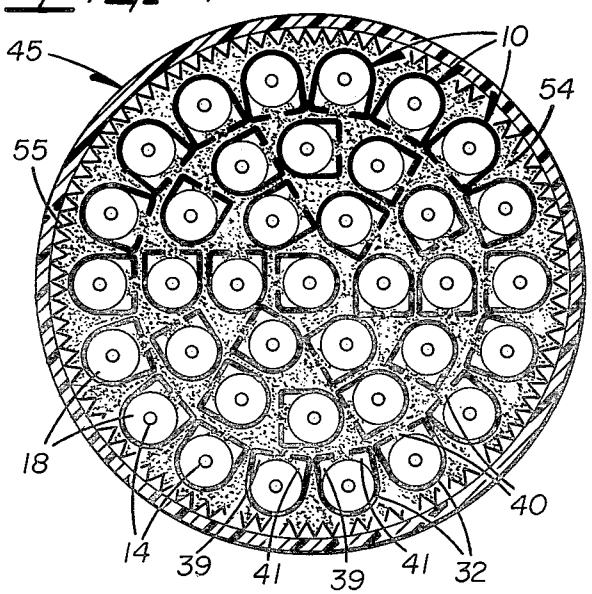
FIG. 7 is a cross-sectional view of FIG. 6 illustrating the compact packaging of the D-shaped coil cases.

Referring now to FIGS. 6 and 7, there is shown a loading coil case assembly that comprises a number of D-packs 10. This assembly includes an outer casing 45 of blow-molded high or medium density polyethylene which, in turn, is made up of a first shell 46 and a second shell 48 welded together at joint 49. The first shell has a neck portion 51, which is secured to a polyethylene jacketed stub cable 52 by a shaped welded polyethylene seal 53. The casing 45 is filled with an encapsulant 54, e.g., polyurethane, which flows through the perforations 33 of the D-pack case and through the openings 40 formed between the ends of the folds 34 and 36. The net effect of the shell constructed of insulation material and the insulating encapsulant is to provide an array of stacked coils, wherein each stack is electrically isolated from the adjacent stacks. The epoxy coated spacer discs insure electrical isolation of the individual coils in the respective stacks.

Interposed between the inner wall of the casing 45 and the circular array of D-packs 10 is a corrugated liner 55 of polypropionate. This corrugated liner acts as a spacer to insure that the encapsulant completely flows around the outer ring of D-packs as shown in FIG. 7. The encapsulant is flowed into the casing 45 through an opening 57, which is subsequently sealed with a plastic plug 58.

Figure 10:
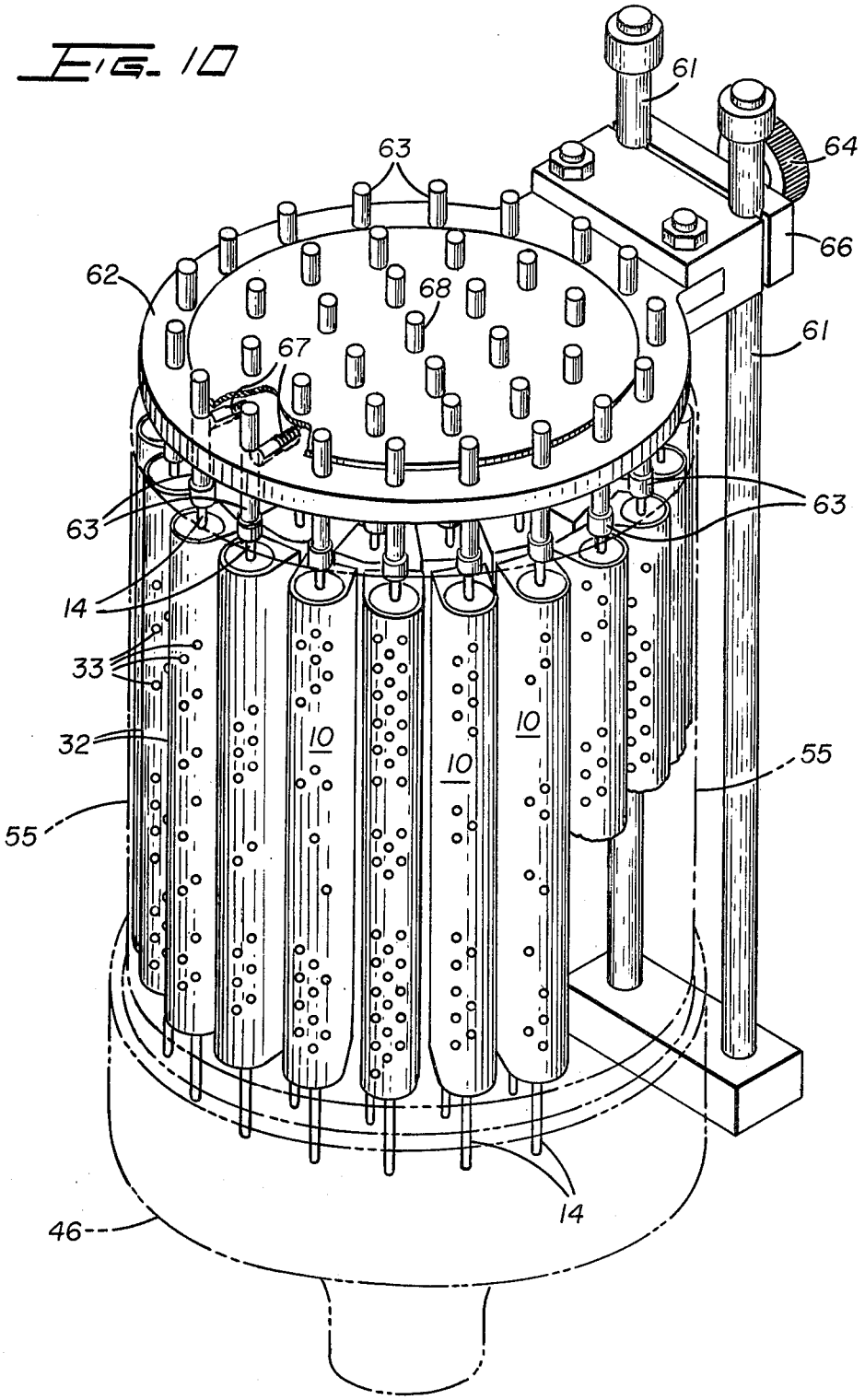
FIG. 10 is a perspective view of a fixture that may be utilized to initially position a number of individual D-shaped coil cases prior to assembly into the outer casing shown in FIGS. 6 and 7.

FIG. 10 shows a simple fixture that may be utilized to facilitate the initial positioning of the D-packs 10 within casing shell 46 prior to assembly in the casing shell 48. The assembly fixture consists of a stand 61 and a projecting circular plate 62 having a number of holes to slidably receive socket-like locating pins 63. The height of the plate 62 relative to the stand 61 may be adjusted by moving a lock knob 64 to release and latch a locking bar 66 onto the stand. The pins 63 are retained in either an up or down position by frictionally engaging the pins with spring 67.

An attending operator will initially take a shell half 46 and position it upside down beneath the plate 62. The pins 63 are moved to the up position and held by the friction springs 67. The operator positions a D-pack 10 under a central pin 68 and then depresses the pin to hold the D-pack in position. Next, the operator will continue to assemble additional D-packs in concentric circular arrays in the manner depicted in FIGS. 7 and 10. In each instance, the operator will position a D-pack 10 and then depress an associated pin 63 to lock the aligned D-pack in position. Following assembly of all D-packs, the corrugated liner 55 is wrapped around the assemblage and retained in position by suitable tie bands constructed of electrically insulating material. The assemblage complete with the shell section 46 is removed from the loading fixture and the second shell 48 is placed over the assembled D-packs and welded to the first shell 46 at joints 49. The assembled shells and D-packs now receive encapsulant which is sealed within casing 45 by the plug 58.

Figure 8:
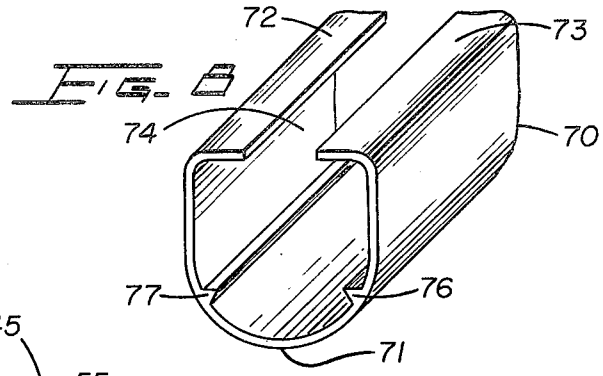
FIG. 8 illustrates an alternative embodiment of the invention in which the D-shaped coil case is formed as a plastic extension with coil spacer ribs.

Referring to FIG. 8, there is shown an alternative embodiment of the D-shaped case. In this instance a D-pack casing 70 is formed by extruding plastic, such as polyethylene, through a suitable die to form arcuate sections 71 and straight sections 72 and 73 separated by an opening 74. During the extrusion, ribs 76 and 77 are formed to project the inner wall of the arcuate section 71. Ribs 76 and 77 act as spacers to hold the toroidal coil away from the inner wall of the extruded case 70 so as to permit the free flow of encapsulant through the opening 74 and about the encased individual toroidal coils.

Figure 9:
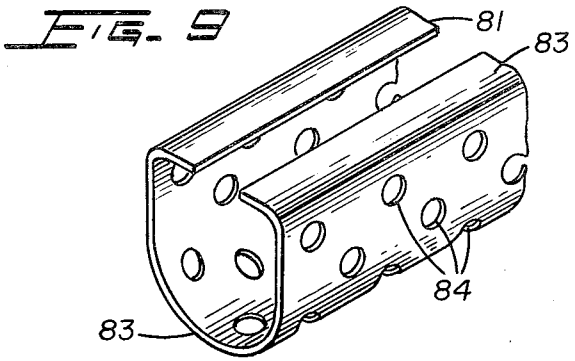
FIG. 9 is a showing of another embodiment of an extruded plastic D-shaped case, which is perforated to facilitate a flow of encapsulating material about the coils positioned within the case.

Attention is directed to FIG. 9, wherein a further embodiment of the D-pack construction is shown. In this instance, a shell or case 80 is extruded to provide straight sections 81 and 82 connected to a common arcuate section 83. The arcuate section 83 is punched to provide a plurality of holes 84 to facilitate the flow of encapsulating material about the encased toroidal coils.

What is claimed is:

1. An inductive coil assembly, which comprises:

a stack of axially aligned toroidal coils;

a D-shaped case positioned about said stack of coils to provide wiring spaces between the peripheries of said coils and the junctures of the straight and arcuate sections of the case; and a pair of terminal strips respectively laid parallel to the axis of the toroidal coils within said wiring spaces and having terminal posts projecting radially of the axis of the stack of toroidal coils into said wiring spaces for securing wires thereto.

2. An inductive coil assembly, as defined in claim 1, wherein the straight section of said D-shaped case has an opening running along the center of the straight section of the case.

3. An inductive coil assembly, as defined in claim 1, wherein the case is provided with a plurality of spaced holes; and an insulating encapsulating material formed about the coils and extending through the holes.

4. An inductive device, as defined in claim 1, wherein the arcuate section of the case is provided with a pair of inwardly extending ribs to space the coils from the inner wall of the case.

5. An inductive coil assembly, as defined in claim 1, wherein the case is formed from a sheet of flat flexible insulating material folded about said stack of cores to provide the arcuate section of said case, and a pair of opposed angularly projecting edge sections which are folded into alignment to form the straight sections.

6. A loading coil package, which comprises: a rod of insulating material;

a stack of toroidal loading coils mounted on said rod;

plastic coated metallic discs interposed between said coils for inductively isolating the coils from each other;

a sheet of plastic material wrapped about and engaging the arcuate sections of said stack of coils to form a D-shaped case, said sheet having straight fold sections extending angularly upward from the plane of the sheet, said angular sections being positioned in the same plane when the sheet is wrapped about the stack of coils to form a straight section of the D-shaped case, said wrapped sheet forming a pair of wiring spaces between the outer peripheries of the coils and the junctures of the arcuate and straight sections of the wrapped sheet;

means for holding the wrapped sheet about the coils with the fold sections in the same plane to form the straight section of the D-shaped case; and a pair of insulating terminal strips individually laid transversely along the periphery of said coils and positioned in said wiring spaces, each of said terminal strips having a plurality of terminal posts projecting radially of the axis of the stack of loading coils into said wiring spaces for attachment thereto of coil wires.

7. A loading coil package as defined in claim 6, wherein the arcuate section of the wrapped sheet is provided with a plurality of holes and an insulating encapsulant is formed about the coils and through the holes.

8. An inductive coil assembly, which comprises:

an elongated housing having a substantially D-shaped cross section, said housing having an opening running the length of the straight section of the D;

a rod extending the length of the housing;

means mounting said rod along the center axis of the arcuate section of said D-shaped housing;

a plurality of toroidal coils mounted on said rod;

a pair of strips of insulating material respectively laid in wiring spaces formed between the peripheries of the toroidal cores and the junctures of the straight and arcuate sections of said D-shaped housing;

terminals mounted on said strips and projecting radially of the axis of the rod into said wiring spaces;

coil wires running from said coils into said wiring spaces and secured to said terminals; and cable wires running along said wiring spaces having first ends secured to said terminals and second ends extending beyond said housing.

9. An inductive coil assembly, which comprises:

a stack of axially aligned toroidal coils;

a casing having an arcuate section surrounding a first portion of the peripheries of said stack of coils, and straight sections extending toward each other from the ends of the arcuate section to form a pair of wiring spaces between the peripheries of the coils and the junctures of the arcuate section and the straight sections;

a pair of insulating mounting strips extending along the peripheries of said coils in parallel relation to the axis of said toroidal coils;

terminals mounted on said mounting strip and extending radially from the axis of said stack of toroidal coils into said wiring spaces; and bundles of cable wires extending into and along said wiring spaces, each of said cable wires connected to a toroidal coil wire by wrapping of the respective coil and cable wires about a terminal.

10. An inductive coil assembly, as defined in claim 9, wherein the casing comprises:

a sheet of flexible insulating material having opposed edge sections diverging in opposed angular directions from the normal plane of the sheet; and banding means wrapped around and forming the sheet to conform to said first portion of the peripheries of said stack of coils and with the angularly extending, opposed edge sections forming the straight sections of the casing.

11. A loading coil assembly, which comprises:

concentric circular arrays of spaced stacks of axially aligned toroidal loading coils;

a D-shaped case positioned about each stack of loading coils with the arcuate section of each case engaging the stack of coils to provide a pair of wiring spaces between the peripheries of each stack of coils and the junctures of the straight and arcuate sections of each case; each of said cases being provided with a plurality of holes;

a pair of terminal strips respectively laid parallel to the axis of each stack of loading coils and within said pair of wiring spaces, each of said strips having terminal posts extending radially of the axis of each stack of loading coils into said wiring spaces and having coil wires secured thereto;

an outer shell casing positioned about said concentric arrays of stacks of loading coils and spaced from the outer concentric circular array of loading coils;

a cable having a plurality of wires extending through the shell and along the wiring spaces, each of said wires hving one end secured to a terminal post; and an encapsulant material filling the outer shell casing and extending through said holes to encapsulate the coils.

* * * * *